United States Patent [19]

Franks, Jr.

[11] Patent Number: 4,780,096

[45] Date of Patent: Oct. 25, 1988

[54] GROUND CLAMP

[76] Inventor: George J. Franks, Jr., 664 Thompson Cir., Inverness, Ill. 60067

[21] Appl. No.: 94,268

[22] Filed: Sep. 8, 1987

[51] Int. Cl.[4] ..... H01R 4/66

[52] U.S. Cl. ..... 439/813; 439/92; 439/799

[58] Field of Search ..... 439/92, 429, 431, 436–439, 439/793, 813, 799; 174/895, 885, 998

[56] References Cited

U.S. PATENT DOCUMENTS

| | | | |
|---|---|---|---|
| 2,458,413 | 1/1949 | Pennell | 439/793 |
| 3,435,126 | 3/1969 | Hamilton | 439/424 X |
| 4,626,051 | 12/1986 | Franks | 439/813 X |

FOREIGN PATENT DOCUMENTS

| | | | |
|---|---|---|---|
| 968431 | 5/1975 | Canada | 439/431 |

*Primary Examiner*—Eugene F. Desmond
*Attorney, Agent, or Firm*—Wall and Roehrig

[57] ABSTRACT

A ground clamp having a clamping strap formed of a corrosive-resisting material with a series of uniformly sized and spaced apertures to facilitate the installation of the clamping strap and clamp onto a wide range of pipe, rod or conduit diameters. A tightening stud, through which the clamping strap is secured about the object to be grounded, includes a terminal portion having a slot therein to receive and have secured thereto one or more terminated ground wires. A pair of curved plates are adjustably positionable along the stud to form a tight clamping action of the clamping strap about the object to be grounded without subjecting the strap to localized stresses or damage. An abrading sleeve is carried by the clamping strap, and positioned thereon to engage the outer surface of the pipe, rod or conduit to be grounded. As the tightening stud tightens the clamping strap about the object to be grounded, a plurality of abrading points, formed on the abrasive sleeve, engage the object to be grounded to cut or scrape through the outer surface thereof as the clamping strap is tightened to ensure a proper electrical contact between the grounding clamp and the object to be grounded.

9 Claims, 1 Drawing Sheet

FIG. 1
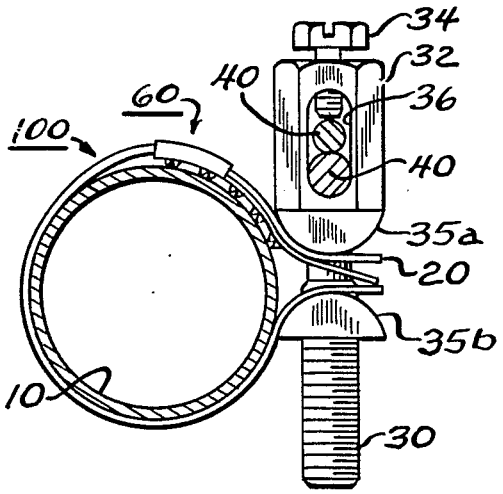
FIG. 2
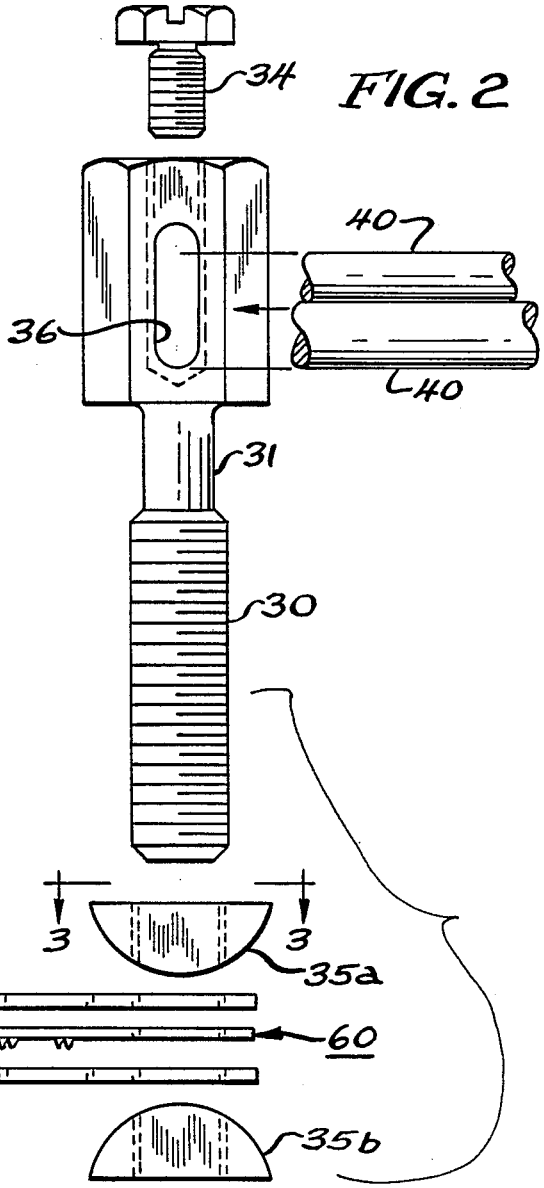
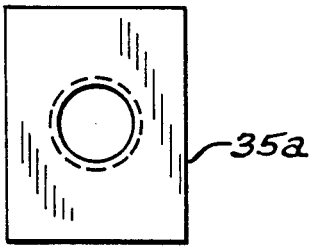
FIG. 3
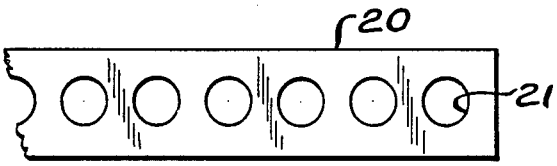
FIG. 4
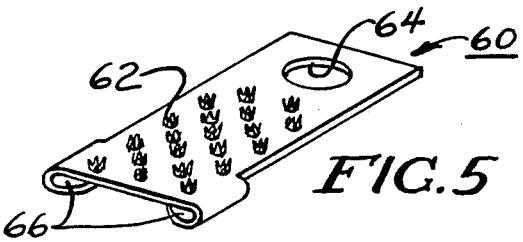
FIG. 5
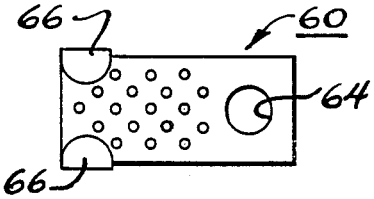
FIG. 6

GROUND CLAMP

BACKGROUND OF THE INVENTION

This invention relates in general to electrical grounding clamps and, in particular, to an improved ground clamp for providing an electrical grounding coupling for use with a pipe, conduit or ground rods of various diameters, which may have a rusted, painted or dirty surface. More specifically, but without restriction to the particular embodiment and/or use which is shown and described for purposes of illustration, this invention relates to a ground clamp adapted to accommodate such things as grounding conductors, water service pipes, electrical service conduits, and ground rods having diameters ranging from as small as ½" to as large as 3½"; and especially for such conductors which have an oxide coating or are paint covered on their exterior surface.

As is known to those skilled in the art, ground clamps are utilized to provide an electrical ground for pipes and conduits, for example, to dissipate static electricity or whenever it is necessary to protect the safety of persons who might come into contact with such instrumentalities. In effecting such grounding, generally a solid copper wire of preferably AWG sizes 6 through 12 inclusive, is appropriately terminated to ground and then connected to the pipe or conduit by a clamp to effect grounding. However, the coupling of the terminated ground wire to the pipe or conduit to be grounded must be done in a proper manner to ensure an effective electrical connection between the pipe or conduit and the terminated ground wire. This coupling or connection must be maintained at all times free from corrosion and mechanical failure, both at the connection with the terminated ground wire, and at the connection to the rod, pipe or conduit.

When a pipe or conduit that is to be ground is covered with paint, rust or some such thin layer of insulating material over the base metal, procedures must be utilized for cleaning the pipe or conduit surface in order to ensure a suitable grounding. While these surface preparation procedures, scaping or sanding the pipe or conduit, are effective in assuring a properly conditioned surface for grounding, these procedures are also time consuming and, on occasions, may be improperly utilized or not used at all. The present invention provides a structure which is effective to ensure a proper contact with the base metal of the pipe or conduit to be grounded, even if the base surface has not been properly scraped or sanded. The present clamp incorporates many features of the inventor's prior invention disclosed and claimed in George J. Franks, Jr., U.S. Pat. No. 4,626,051, the disclosure of which is incorporated herein by reference.

SUMMARY OF THE INVENTION

It is, therefore, an object of this invention to improve ground clamps for coupling a terminated ground wire to a pipe, rod or conduit for grounding purposes.

Another object of this invention is to improve the mechanical and electrical coupling of the ground clamp to the pipe, rod, conduit or object being grounded.

A further object of this invention is to ensure the proper preparation of the surface of an object to be grounded by penetrating through any surface coatings such as oxide formations or paint.

These and other objects are attained in accordance with the present invention wherein there is provided a ground clamp having a clamping strap formed of a corrosive-resisting material with a series of uniformly sized and spaced apertures to facilitate the installation of the clamping strap and clamp onto a wide range of pipe, rod or conduit diameters. A tightening stud, through which the clamping strap is secured about the object to be grounded, includes a terminal portion having a slot therein to receive and have secured thereto one or more terminated ground wires. A pair of curved plates are adjustably positionable along the stud to form a tight clamping action of the clamping strap about the object to be grounded without subjecting the strap to localized stresses or damage. An abrading sleeve is carried by the clamping strap, and positioned thereon to engage the outer surface of the pipe, rod or conduit to be grounded. As the tightening stud tightens the clamping strap about the object to be grounded, a plurality of abrading points, formed on the abrasive sleeve, engage the object to be grounded to cut or scrape through the outer surface thereof as the clamping strap is tightened to ensure a proper electrical contact between the grounding clamp and the object to be grounded.

DESCRIPTION OF THE DRAWINGS

Further objects of the invention, together with additional features contributing thereto and advantages accruing therefrom will be apparent from the following description of a preferred embodiment of the invention which is shown in the accompanying drawings with like reference numerals indicating corresponding parts throughout, wherein:

FIG. 1 is a frontal planar view of the ground clamp with the clamping strap encircled about a pipe to be grounded showing the abrading sleeve engaging the outer surface thereof;

FIG. 2 is an enlarged exploded view of the ground clamp to better illustrate the components and assembly thereof;

FIG. 3 is a top planar view of one of the curved plates utilized with the ground clamp taken along the lines 3—3 of FIG. 2;

FIG. 4 is a top planar view of a coupling strap used with the grounding clamp to better illustrate the manner in which a plurality of apertures or holes formed therein are used to facilitate use of the ground clamp on various diameters of pipes, rods or conduits;

FIG. 5 is a perspective view of the abrading sleeve carried by the clamping strap to ensure the desired electrical contact between the clamp and the object to be grounded; and FIG. 6 is a planar view of the abrading sleeve to better illustrate the features thereof.

DESCRIPTION OF A PREFERRED EMBODIMENT

Referring now to FIG. 1, there is shown a ground clamp 100 in an assembled configuration with a clamp strap 20 secured about a pipe, conduit or rod 10 which is to be grounded. As shown in more detail in FIGS. 5 and 6, the ground clamp includes an abrasive sleeve 60 which is fabricated in a somewhat T-shape form, perferably from beryllium copper or stainless steel. The abrasive sleeve 60 has a plurality of holes punched therethrough to form sharp, jagged edges 62 which extend outwardly from the surface of the abrasive sleeve 60. A hole 64 is formed in one end of the abrasive sleeve to receive a threaded stud 30 when the abrasive sleeve 60 is positioned on the clamping strap 20 for engagement with an object to be grounded.

As best seen in FIG. 5, the cross bar portion 66, which extends transversely outward from the stem portion of the T-shaped abrasive sleeve 60, are folded back upon that portion, but leaving a sufficient space between the cross bat portion 66 and the stem of the abrasive sleeve 60 so that the sleeve may be received onto the clamping strap 20 in the manner best illustrated in FIG. 1. In the illustrated configuration, the abrasive sleeve 60 is carried upon the inner surface of the clamping strap 20 in engagement with a pipe, rod or conduit to be grounded. The abrading points 62 extend outwardly from the abrasive sleeve 60 into engagement with the object to be grounded to enable the points to cut and/or abrade through any oxide or paint coating on the outer surface of the object to be grounded.

The threaded stud 30 is formed with a shank portion 31, void of any thread, and a hexagonally-shaped head 32 through which the stud 30 may be turned relative to a pair of curved securing plates 35, each of which has an internal thread complimenting the external thread on the stud 30. The top of the hexagonally-shaped head 32 of the stud 30 has a threaded internal bore 33 extending coaxially with the longitudinal axis of the stud 30. The bore 33 is threaded to accommodate the external threads of a terminated ground wire securing screw 34, which functions to secure one or more terminated ground wires 40 to the stud 30.

As best shown in FIGS. 1 and 2, the head 32 of the stud 30 is formed with a slot 36 extending transversely to the longitudinal axis of the stud and passing completely through the stud head. In this manner, one or more terminated ground wires 40 may be positioned into the slot 36, and the securing screw 34 tightened to fixedly secure the ground wires through the stud. In this manner, the terminated ground wires 40 are secured by the compressive force of the securing screw 34 within the slot 36 free from any securing stress.

The clamping strap 20 is preferably formed from a corrosive-resisting copper or copper alloy, and in use is positioned with the stud 30 passing through the first hole 21 formed adjacent to the end of the strap. The stud 30 is passed through a fastening hole 64 formed in the abrasive sleeve 60 to fix one end of the abrasive sleeve 60 in a predetermined position. The clamping strap 20 is then encircled about the pipe 10, and the stud 30 is again inserted through a hole in the clamping strap 20 to encircle the object to be grounded. The pair of curved plates **35*a* and 35*b* are carried upon the stud 30**, and function in a manner disclosed in the inventor's prior patent.

When the stud 30 is turned, the uppermost curved plate **35*a*, being positioned upon the unthreaded shank portion 31 of the stud 30, is maintained in a fixed position while the stud 30 rotates relative thereto. The lowermost curved plate 35*b* will be moved vertically upward relative to the uppermost curved plate 35*a* in response to rotation of the stud 30. In this manner, the clamping strap 20 and the abrasive sleeve 60 will be drawn tightly about the conduit 10, with the cutting points 62 of the abrasive sleeve 60 cutting and/or abrading into the outer surface of the conduit 10 as the clamping strap 20 is drawn tightly thereabout. In this manner, an intimate electrical connection is made between the ground clamp and the object to be grounded even if the outer surface of the conduit 10** is coated with an oxide or a paint which has not been removed by sanding or scraping.

While the abrading sleeve 60 is illustrated in a preferred manner as being partially wrapped about the clamping strap by means of the folded back cross bar portions 66, it is to be understood that the transversely extending cross bar portions 66 do not have to be formed as folding about the clamping strap 20. The abrading sleeve may include only an upwardly turned portion of the T-shape to form a guide against the edges of the clamping strap 20. It is believed that even such guides may be omitted with the abrading sleeve being entirely flat. However, with such an omission the abrasive sleeve 60 would have a tendency to be free to pivot about the stud 30 relative to the clamping strap and, therefore, it is believed that the embodiment disclosed is preferable.

While the invention has beeen described in the specification and illustrated in the drawings with reference to a preferred embodiment, it will be understood by those skilled in the art that various changes may be made and equivalents may be substituted for elements thereof without departing from the scope of the invention as defined in the claims. In addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the description of the appended claims.

I claim:

1. An abrading strap for positioning on the clamping strap of a grounding clamp to couple an electrical ground to an object such as a conduit, pipe or ground rod, comprising a planar strip of electrically conductive material having a mounting hole formed in an end thereof and a plurality of cutting edge forming holes formed through said strip, and means for positioning said strip in a position parallel to the clamping strap when positioned thereon.

said planar strip being T-shaped and said means for positioning said strip in a position parallel to the clamping strap comprising a portion of said T-shaped strip being folded upon itself.

2. A clamping device for coupling an electrical ground to an object such as a conduit, pipe or ground rod comprising clamping strap means having at least a first and a second circular clearance hole formed therein and adapted to be placed about and in contact with at least a portion of the peripheral surface of an object to be grounded for forming an electrical and mechanical coupling thereto, abrading means carried by said clamping strap and positioned thereby to contact the outer peripheral surface of an object to be grounded for penetrating the outer surface thereof to enhance electrical coupling thereto, fastening means for tightening said clamping strap means and said abrading means about an object to be grounded including a threaded stud positionable through said first and second circular clearance holes formed in said clamping strap means after said clamping strap means has been positioned about at least a portion of the peripheral surface of the object to be grounded, a first and a second securing plate supported on said threaded stud with said clamping strap means being positioned on said threaded stud between said securing plates, said first and second securing plates each being formed with a curved face which contacts said clamping strap means and supported on said threaded stud with said curved faces positioned adjacent each other with one of said curved faces on each side of said clamping strap means positioned therebetween, said first and second securing plates carried upon said threaded stud for converging movement relative to each other upon rotation of said stud to thereby tighten said clamping strap and said abrading means against an object to be grounded and to penetrate the surface thereof, and means for securing a terminated ground wire to said clamping device, said clamping strap means being formed with a series of uniformly spaced holes to facilitate mechanical coupling to various size object to be grounded, and said abrading means including a strap having a hole therein through which said threaded stud is passed.

3. A clamping device for coupling an electrical ground to an object such as a conduit, pipe or ground rod comprising clamping strap means having at least a first and a second circular clearance hole formed therein and adapted to be placed about and in contact with at least a portion of the peripheral surface of an object to be grounded for forming an electrical and mechanical coupling thereto, abrading means carried by said clamping strap and positioned thereby to contact the outer peripheral surface of an object to be grounded for penetrating the outer surface thereof to enhance electrical coupling thereto, fastening means for tightening said clamping strap means and said abrading means about an object to be grounded including a threaded stud positionable through said first and second circular clearance holes formed in said clamping strap means after said clamping strap means has been positioned about at least a portion of the peripheral surface of the object to be grounded, a first and second securing plate supported on said threaded stud with said clamping strap means being positioned on said threaded stud between said securing plates, said first and second securing plates each being formed with a curved face which contacts said clamping strap means and supported on said threaded stud with said curved faces positioned adjacent each other with one of said curved faces on each side of said clamping strap means positioned therebetween, said first and second securing plates carried upon said threaded stud for converging movement relative to each other upon rotation of said stud to thereby tighten said clamping strap and said abrading means against an object to be grounded and to penetrate the surface thereof, and means for securing a terminated ground wire to said clamping device.

4. A clamping device as defined by claim 3 wherein said threaded stud has a shank portion void of threads and said first securing plate is supported upon said shank portion of said threaded stud which is void of threads.

5. A clamping device as defined by claim 3 wherein said means for securing a terminated ground wire to said clamping device includes a head portion formed at one end of said threaded stud, and said head portion has a slot extending therethrough in a direction transverse to the longitudinal axis of said threaded stud for receiving therein a plurality of terminated ground wires.

6. A clamping device as defined by claim 3 wherein said curved face of each of said first and second securing plates is formed to conform said clamping strap means in a configuration tangential with an object about which said clamping strap means is placed at a nip formed between the object and said curved face of said securing plates and extending therefrom over said curved faces into a position wherein the ends of said clamping strap means converge towards one another.

7. A clamping device as defined by claim 3 wherein said curved face of each one of said first and second securing plates is curved from a point thereupon which defines the closest distance between said adjacent faces of said first and second securing plates to the edge thereof which in use is positioned adjacent to the peripheral surface of an object to be grounded.

8. A clamping device as defined by claim 3 wherein said abrading means comprises an abrading strap having a hole formed therein through which said fastening means extends.

9. A clamping device as defined by claim 8 wherein said abrading strap is formed with a plurality of cutting edges for cutting the surface of an object to be grounded.

* * * * *